US006050164A

United States Patent [19]

Kuchta

[11] Patent Number: 6,050,164

[45] Date of Patent: Apr. 18, 2000

[54] ADJUSTABLE RESEALER

[75] Inventor: Richard Kuchta, Shickshinny, Pa.

[73] Assignee: Gerber Technology, Inc., Tolland, Conn.

[21] Appl. No.: 09/116,436

[22] Filed: Jul. 15, 1998

[51] Int. Cl.[7] ..... B26D 7/02

[52] U.S. Cl. ..... 83/56; 83/941; 83/451; 83/152

[58] Field of Search ..... 83/56, 19, 936–41, 83/451, 385, 152; 242/107; 198/689.1

[56] References Cited

U.S. PATENT DOCUMENTS

| | | | |
|---|---|---|---|
| 4,434,691 | 3/1984 | LeBlond . | |
| 4,452,113 | 6/1984 | Pearl . | |
| 4,542,673 | 9/1985 | Pearl . | |
| 5,001,954 | 3/1991 | Galan et al. | 83/451 |
| 5,282,407 | 2/1994 | Arikita | 83/941 X |
| 5,289,748 | 3/1994 | Kuchta et al. . | |
| 5,596,917 | 1/1997 | Gerber et al. | 83/152 |
| 5,819,620 | 10/1998 | Bouvarel et al. | 83/937 X |

*Primary Examiner*—Rinaldi I. Rada
*Assistant Examiner*—T. Anthony Vaughn
*Attorney, Agent, or Firm*—McCormick, Paulding & Huber LLP

[57] ABSTRACT

A cutter system for cutting a single ply or multiple plies of limp material, or a lay, into a plurality of parts includes a cutter table for supporting the lay with a cutter head for cutting the lay and a resealer apparatus for sealing the cuts made in the lay. The resealer apparatus includes a first resealer mechanism associated with one end of the cutter table and a second resealer mechanism adjustably attaching onto a cutter head beam and being moveable therewith. The second resealer mechanism includes a pair of adjustable sides that attach the second resealer mechanism to the cutter head beam and that support a resealer roll such that the adjustable sides can be adjusted to vary the distance between the resealer roll and the cutter table support surface and vary the proximity of the resealer roll to the cutter tool.

13 Claims, 4 Drawing Sheets

ADJUSTABLE RESEALER

BACKGROUND OF THE INVENTION

1. Technical Field

The present invention relates to cloth cutters and, more particularly, to resealing mechanisms for resealing the cuts made by the cutter during cutting operations to minimize vacuum loss.

2. Background Art

Conventional cloth cutter systems include a cutter table and a cutter head movable with respect to the cutter table in a longitudinal direction and guided by a pair of rails disposed along the cutter table. The cutter table supports a single ply or multiple plies of cloth material, referred to as a lay. The cutter table extends from Typically, the cutter table includes an air permeable support surface to allow vacuum air to pass therethrough. The vacuum draws the lay against the cutter table support surface to prevent displacement of the lay during the cutting operations and to compress the lay during the cutting operations. In order to achieve and maintain the vacuum during the cutting operations, a layer of air impermeable overlay material is placed atop of the lay prior to the onset of the cutting operations. Typically, the overlay material is a thin plastic film that can be easily cut by the cutter tool.

During the cutting operation, the overlay material is held in place by vacuum. However, as the cutter tool cuts the lay into parts, the overlay material is also cut. Once the overlay material is cut, the air can permeate through the cuts and causes loss of vacuum. The resulting loss of vacuum during the cutting operations is highly undesirable because the plies of material are no longer compressed or held in place, resulting in inaccurate subsequent cuts.

Existing cutter systems include a resealer mechanism to seal the cuts and thereby conserve vacuum. One such resealer is described in a U.S. Pat. No. 5,289,748 to Kuchta et al. and assigned to a common assignee with the present invention. Conventional resealer mechanisms include a first roll with resealer material attached to one end of the cutter table and a second roll with resealer material that moves with the cutter head. These resealer mechanisms typically include a pair of rigid brackets that support the second roll with resealer material. The brackets attach to the end castings of the cutter head such that the second resealer roll travels in the longitudinal direction with a cutter head. The second roll with the resealer material must be positioned sufficiently far above the cutter table support surface to accommodate lays of maximum height.

However, many cutting operations involve cutting smaller lays. Therefore, for those cutting operations, the gap between the second resealer roll and the top of the lay is large, resulting in vacuum loss. Because a large gap is formed between the second resealer roll and the top of the lay, the vacuum that passes through the cuts cannot overcome the rewinding force of the resealer roll and cannot immediately draw the resealer material coming off the resealer roll toward the lay to reseal the cuts. This results in an area of cut lay that is not immediately resealed.

Additionally, the geometry of the cutter head interferes with the second resealer roll and therefore prevents the second resealer roll from being in close proximity to the cutter tool. Thus, the resealer roll is positioned away from the tool, resulting in vacuum losses. Furthermore, the problem is exacerbated by newer, wider cutters. In the wider cutters, a greater total area of the cut lay is exposed, and therefore more vacuum air can escape through the cuts.

It is an object of the present invention to improve cutter systems.

It is the another object of the present invention to provide a resealer mechanism that minimizes vacuum loss during cutting operations.

SUMMARY OF THE INVENTION

The present invention resides in a method and apparatus for cutting limp sheet material while the material is held firmly in position on a cutter table by vacuum with a resealer apparatus resealing cuts made during the cutting operation to minimize vacuum loss. In accordance with the present invention, the resealer apparatus includes a first resealer mechanism associated with one end of the cutter table and a second resealer mechanism adjustably attaching onto a cutter head beam and being moveable therewith. The second resealer mechanism includes a pair of adjustable sides that couple the second resealer mechanism to the cutter head beam and that support a resealer roll such that the adjustable sides can be adjusted to vary the distance between the resealer roll and the cutter table support surface and vary the proximity of the resealer roll to the cutter tool.

The adjustable resealer mechanism of the present invention minimizes vacuum loss during cutting operations. The operator can adjust the resealer for optimum results. The present invention enables the operator to adjust both the gap between the resealer roll and the top of the lay and proximity of the resealer roll to the cutter tool.

One advantage of the present invention is that the distance between the resealer roll and the cutter table support surface can be adjusted such that the resealer material can be drawn by the vacuum as soon as the resealer material is unwound from the resealer roll.

Another advantage of the present invention is that as a result of the resealer adjustability, interference between the resealer roll and the cutter head can be avoided and the resealer roll can be brought into dose proximity to the cutter tool.

The foregoing and other advantages of the present invention become more apparent in light of the following detailed description of the exemplary embodiments thereof, as illustrated in the accompanying drawings.

DETAILED DESCRIPTION OF THE INVENTION

Figure 1:
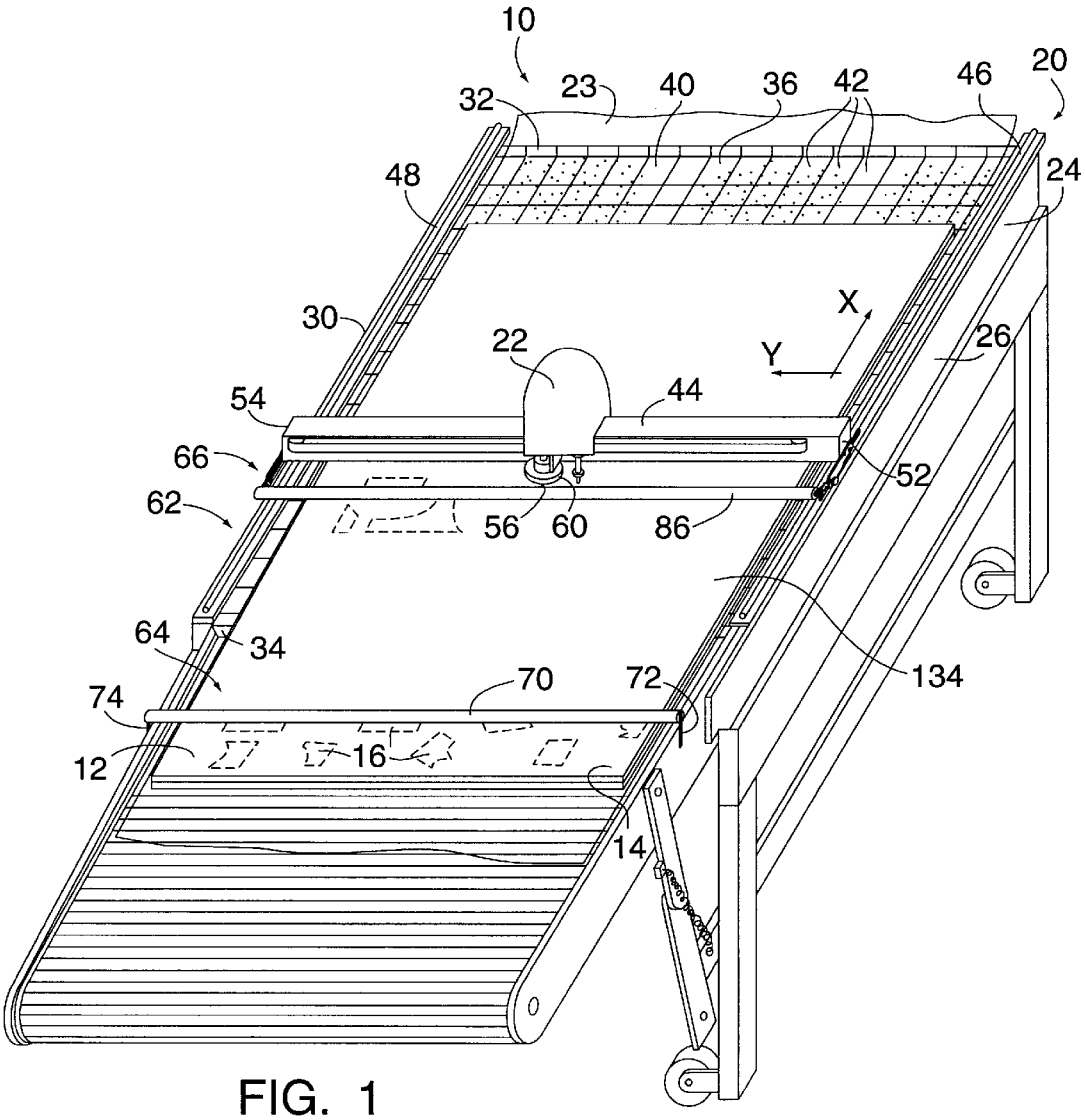
FIG. 1 is a simplified perspective view of a cutter apparatus with a resealer system.

Referring to FIG. 1, a cutting apparatus 10 for cutting a single ply or multiple plies 12 of limp material, referred to as a lay 14, into individual parts 16 of predetermined size and shape includes a cutter table 20 for supporting the lay 14 and a cutter head 22 movable with respect to the cutter table 20. A layer of an overlay material 23 is disposed atop of the lay 14. The cutter table 20 includes a frame 24 and extends in a lateral, or Y-coordinate, direction from a console side 26 to a remote side 30 and in a longitudinal, or X-coordinate, direction from a take-on end 32 to a take-off end 34.

The cutter table 20 also includes a conveyor 36 for moving the lay 14 from the take-on end 32 to the take-off end 34. The conveyor 36 includes an air permeable support surface 40 comprised of a plurality of bristle blocks 42. A vacuum source (not shown) is disposed underneath the support surface 40. The cutter head 22 is supported by a cutter head beam 44 that is movable in the X-coordinate direction along a pair of guide rails 46, 48 secured to the cutter frame 24. The cutter head beam 44 includes a first beam end 52 and a second beam end 54. The cutter head 22 moves in the lateral or Y-coordinate direction across the cutter head beam 44. A cutter tool 56 is supported within the cutter head 22. A presser foot bowl 60 is also supported by the cutter head 22 and surrounds the cutter tool 56. As is well known in the art, the presser foot bowl 60 is movable vertically to accommodate lays of various heights.

A resealer system 62 includes a fixed resealer mechanism 64 and an adjustable resealer mechanism 66. The fixed resealer mechanism 64 is disposed on the take-off end 34 of the cutter table 20 and is fixedly attached thereto. The fixed resealer mechanism 64 includes a first resealer roll 70 supported by fixed resealer brackets 72, 74.

Figure 2:
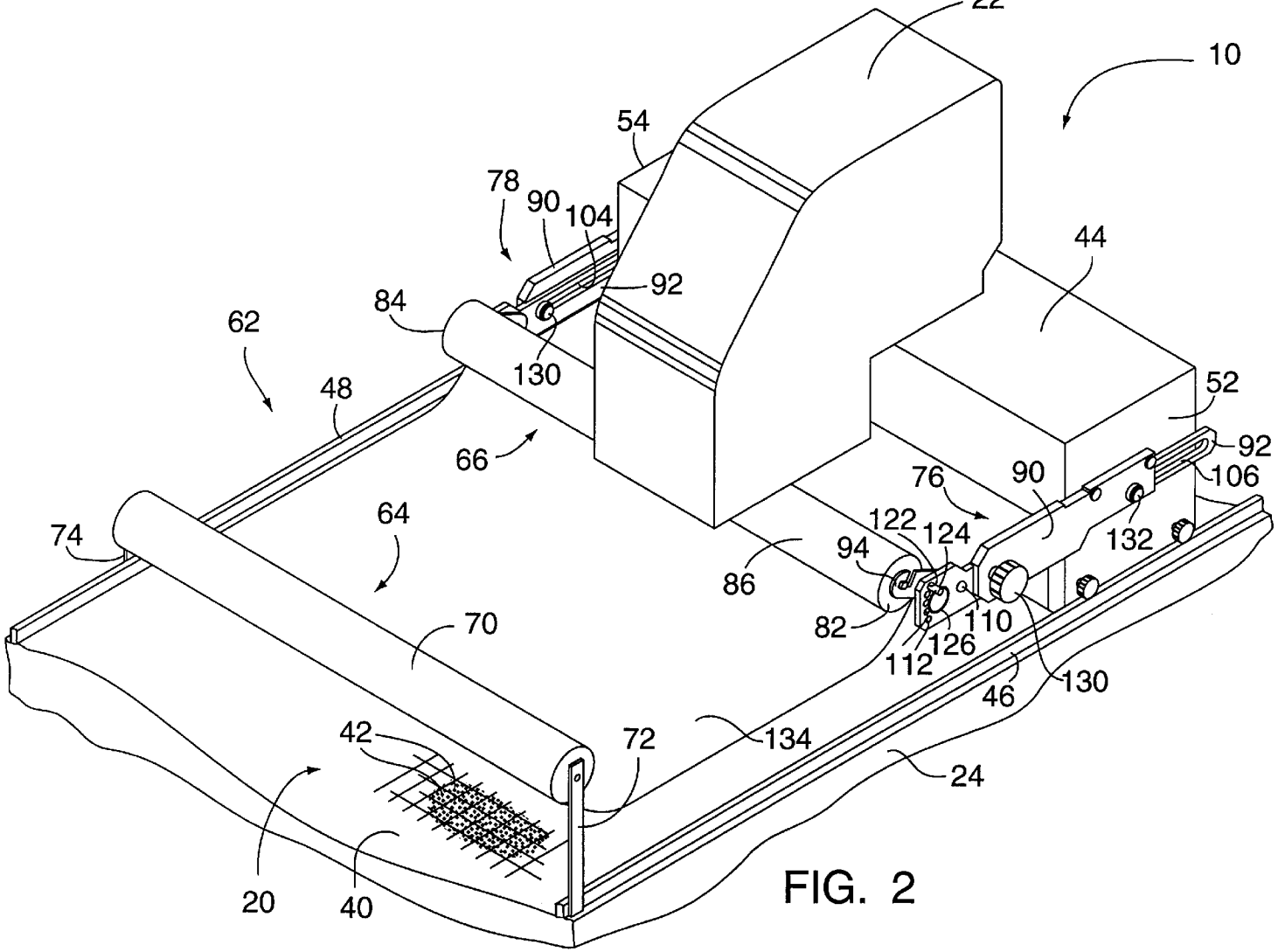
FIG. 2 is an enlarged, fragmentary, simplified perspective view of the cutter apparatus with the resealer system of FIG. 1.

Referring to FIG. 2, the adjustable resealer mechanism 66 is attached to the cutter head beam 44 and moves therewith. The adjustable resealer mechanism 66 includes a first side assembly 76 and a second side assembly 78 supporting first and second ends 82, 84 of a second resealer roll 86, respectively . Each side assembly 76, 78 includes a main body bracket 90 fixedly attaching onto the beam end 52,54, a slide 92 movably attaching onto the bracket 90, and an adjustable arm 94 pivotably secured to the slide 92. The bracket 90 includes a substantially planar body with a plurality of fastener openings 96 formed therein for a respective plurality of fasteners to pass therethrough for attaching the bracket 90 to the cutter beam ends 52, 54.

Figure 3:
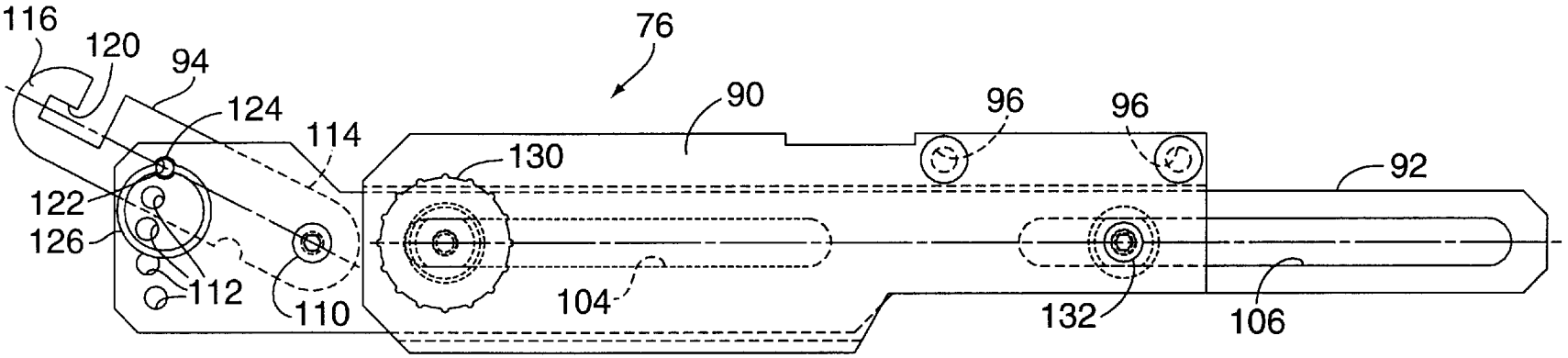
FIG. 3 is a schematic, front view of a bracket for an adjustable resealer mechanism of the resealer system of FIG. 2.

The slide 92 includes an elongated, substantially planar slide body with first and second slots 104, 106 formed therein, as best seen in FIG. 3. Each slot 104, 106 extends longitudinally with both slots 104, 106 being formed on the substantially same center line. The slide 92 also includes a pivot 110 for pivotably securing the arm 94 thereto and a plurality of slide pin openings 112 spaced apart from each other at a predetermined distance and spaced from the pivot 110 at a predetermined radius.

Referring to FIG. 3, the arm 94 includes a first arm end 114 and a second arm end 116 with the first arm end 114 pivoting about the pivot 110 of the slide 92. The second arm end 116 is free to rotate and includes an arm slot 120 adopted for securing the resealer roll end 82, 84. The arm 94 also includes an arm pin opening 122 to be positioned in register with one of the slide openings 112. In the preferred embodiment of the present invention, the arm pin opening 122, the arm slot 120 and the pivot 110 are disposed along the same center line.

A locking pin 124 passes through the arm pin opening 122 and one of the slide pin openings 112 to fixedly position the arm 94 in a desirable position. The locking pin 124 includes a ring 126 to facilitate easy removal of the pin from the slide and arm pin openings 112, 122. A friction lock knob 130 is attached to the bracket 90 and passes through the first slot 104 of the slide 92, securing the slide 92 to the bracket 90. The friction lock knob 130 can be loosened to facilitate adjustment of the side assemblies 76, 78 in the longitudinal direction. A guide 132 is attached to the bracket 90 and passes through the second slot 106 to allow sliding movement between the slide 92 and the bracket 90, while maintaining the slide 92 and the bracket 90 in close proximity.

The first and second resealer rolls 70, 86 are connected by a resealer material 134, as best seen in FIGS. 1 & 2. Each resealer roll 70, 86 includes a self-rewinding mechanism, as is well known in the art, such that the two resealer rolls 70, 86 are self-balancing.

In operation, the limp material lay 14 is introduced at the take-on end 32 of the cutting table 20. The conveyor 36 advances the lay 14 to a predetermined position for the lay 14 to be cut in accordance with a cutting program resident in the cutter head 22. The layer of overlay material 23 is placed atop of the lay 14 with the vacuum source activated and drawing the lay 14 and the overlay material 23 toward the cutter table surface 40. Once the height of the lay 14 is established, the adjustable resealer mechanism 66 is adjusted for optimum results. The locking pin ring 126 is pulled to remove the locking pin 124 from the slide and arm pin openings 112, 122. The arm 94 is then pivoted to an appropriate height to accommodate the lay 14. The arm 94 is pivoted to position the arm pin opening 122 in register with the appropriate slide pin opening 112. The locking pin 124 then engages the arm pin opening 122 and the appropriate slide pin opening 112 to lock the arm 94 with respect to the slide 92 at the appropriate height.

Once the height of the resealer roll 86 is adjusted, the proximity of the resealer roll 86 to the presser foot bowl 60 can be adjusted also. The knob 130 is loosened to allow movement between the bracket 90 and the slide 92. The slide 92 is moved an appropriate amount with respect to the bracket 90 such that the arms 94 supporting the resealer roll 86 are either moved closer or farther from the presser foot bowl 60. The guide 132 provides additional stability and prevents the slide from pivoting about the bracket 90.

The other side assembly 78 is adjusted analogously to ensure that both resealer side assemblies 76, 78 are adjusted substantially identically.

During the cutting operation, the cutter head 22 moves in the lateral or Y-coordinate direction along the cutter head beam 44 and the cutter head beam 44 moves in the longitudinal or X-coordinate direction along the guide rails 46, 48, in accordance with the cutting program. As the cutter head beam 44 moves in a longitudinal direction from the take-off end 34 to the take-on end 32, the adjustable resealer mechanism 66 moves therewith. As the adjustable resealer 66 moves away from the fixed resealer 64, the resealer material 134 is pulled from the resealer rolls. The resealer rolls 70, 86 include a sufficient length of the resealer material 134 for the resealer material 134 to extend the full longitudinal length of the cutter table 20 when the cutter head beam 44 travels to the take-on end 32 of the cutter table 20. As the cutter head beam 44 moves toward the take-off end 34 of the cutter table 20, the resealer rolls 70, 86 take up the resealer material 134. As the cutter tool 56 cuts the lay 14 and the overlay material 23, the vacuum air permeates through the cuts and draws the resealer material 134 toward the top of the lay 14, thereby sealing the cuts.

Figure 4:
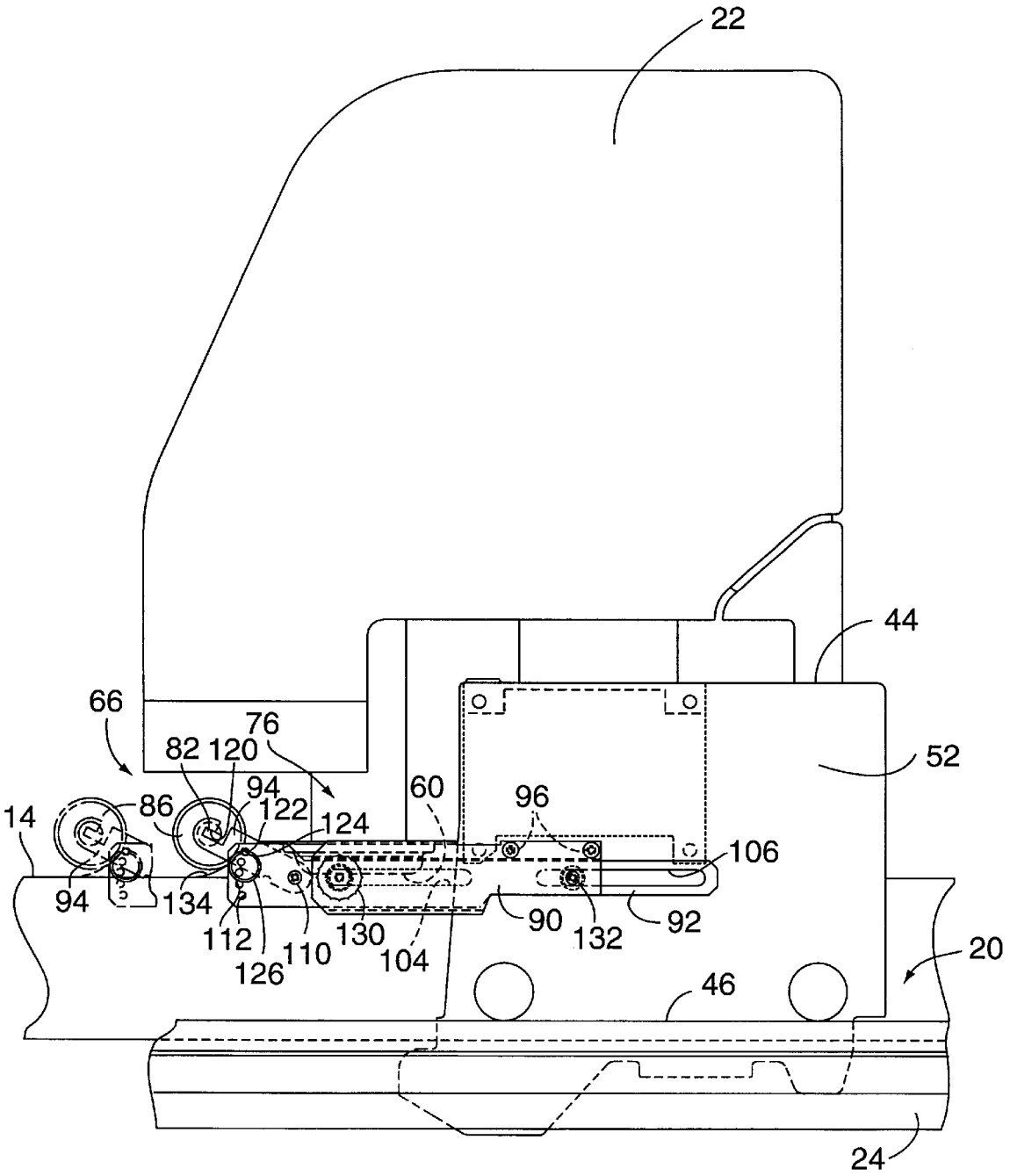
FIG. 4 is a simplified side view of a cutter head and a cutter head beam of the cutter apparatus with the adjustable resealer mechanism of the resealer system of FIG. 2.

The adjustable resealer mechanism 66 of the present invention minimizes vacuum loss during cutting operations. The operator can adjust the resealer 66 for optimum results. The present invention enables the operator to bring the second resealer roll 86 into very close proximity to the cutter tool 56 by adjusting the relative positions of the bracket 90 and the slide 92, as best seen in FIG. 4. In an optimum position, the second resealer roll 86 can be brought substantially tangent to the presser foot bowl 60. In this optimum position, the cuts in the lay 14 are sealed essentially immediately after formed. This results in great savings of vacuum, especially for wider lays supported by wide cutter tables 20 and when cutting very small parts 16 that require many cuts in a small area. The longitudinal adjustability of the second resealer roll 86 also allows the operator to pull the second resealer roll 86 farther away from the cutter head for some cutting operations when the operator needs to observe the cutting tool during the operation. This also enables mechanics to work on the cutter head 22 without having to disassemble the resealer mechanism.

The adjustable resealer 66 also improves cutter system 10 performance by allowing height adjustability of the resealer roll 86. The adjustable resealer 66 of the present invention allows the resealer roll 86 to be positioned directly above the top of the lay 14. This allows the resealer material 134 to be drawn by the vacuum toward the top of the lay 14 to reseal the cuts immediately after the material 134 is unwound from the second resealer roll 86. This is an improvement over the prior art because the resealer rolls of the prior were gauged and fixed for the maximum height of the lay. The majority of jobs using prior art had resealer rolls that were too far above the lay top surface for the vacuum to overcome the rewinding forces of the resealer roll.

While the present invention has been illustrated and described with respect to a particular embodiment thereof, it should be appreciated by those of ordinary skill in the art, that various modifications to this invention may be made without departing from the spirit and scope of the present invention. For example, the adjustable resealer 66 of the present invention is compatible with various types of fixed resealer mechanisms 64 and should not be limited to use with the fixed resealer 64 described herein.

I claim:

1. A resealer apparatus for sealing cuts formed in a lay of limp material by a cutter tool supported by a cutter head with said cutter head being moveable in one coordinate direction along a cutter head beam, said lay being supported by a cutter table support surface of a cutter table, said cutter head beam being moveable with respect to said cutter table in a second coordinate direction and having a first beam end and a second beam end, said resealer apparatus comprising:

a first resealer mechanism including a first resealer roll supported by a pair of first resealer members, said first resealer members attaching onto a frame of said cutter table and being associated with one end of said cutter table;

a second resealer mechanism including a second resealer roll supported by a pair of adjustable sides, each of said pair of adjustable sides being attached to said first and second beam ends respectively and being moveable with said cutter head beam, each of said adjustable sides being adjusted to position said second resealer roll at a predetermined optimum height with respect to said cutter table support surface and to position said second resealer roll at a predetermined optimum proximity to said cutter tool; and an elongated sheet of air impermeable resealer material having opposite ends wound about said first and second resealer rolls respectively with a portion of said resealer material extending between said first and second rolls in response to the movement of said cutter head beam along said cutter table.

2. The resealer apparatus according to claim 1 wherein each said adjustable side comprises:

a bracket attaching said adjustable side to said beam end;

a slide slidably attached to said bracket for adjusting proximity of one end of said slide to said cutter tool; and an adjustable arm with one end thereof pivotably attaching onto said slide and with another end thereof supporting said second resealer roll, said arm pivotable about a pivot to position said second resealer roll at a predetermined optimum height with respect to said cutter table support surface.

3. The resealer apparatus according to claim 2 wherein each said adjustable side further comprises:

means for attaching said slide to said bracket, said means being adjustable to allow relative movement between said slide and said bracket.

4. The resealer apparatus according to claim 3 wherein said means for attaching is a friction lock knob fixedly attaching to said bracket and passing through a first slot formed within said slide, said friction lock knob being loosened to allow sliding movement of said slide relative to said bracket and being tightened to secure said slide relative to said bracket in a predetermined position.

5. The resealer apparatus according to claim 3 wherein each said adjustable side further comprises:

means for guiding said slide relative to said bracket, said means for guiding being spaced apart from said means for attaching.

6. The resealer apparatus according to claim 2 wherein each said adjustable side further comprises:

a locking pin for locking said arm in a predetermined position relative to said slide;

said slide including a plurality of slide pin openings being spaced at a predetermined radius from said pivot and being spaced apart at a predetermined distance from each other with each said slide pin opening being adapted to receive said locking pin;

said arm including an arm pin opening being spaced at said predetermined radius from said pivot to be in register with one of said plurality of slide pin openings, said arm pin opening being adapted to receive said locking pin when said arm is positioned such that said arm pin opening is in register with one of said plurality of slide pin openings.

7. A cutter system for cutting a lay of limp material into a plurality of parts, said cutter system comprising:

a cutter table for supporting said lay, said cutter table including an air permeable support surface for allowing vacuum air to pass therethrough;

a cutter tool for penetrating and cutting said lay;

a cutter head supporting said cutter tool;

a cutter head beam movably supporting said cutter head with said cutter head being movable with respect to said cutter beam in one coordinate direction, said cutter head beam being movable with respect to said cutter table in a second coordinate direction, said cutter beam having a first beam end and a second beam end; and a resealer apparatus having a first resealer mechanism and a second resealer mechanism with an air impermeable resealer material having a first and a second resealer material ends extending between said first and second resealer mechanisms;

said first resealer mechanism including a first resealer roll supported by a pair of first resealer members with said first resealer material end wound thereon, said first resealer members attaching onto a frame of said cutter table and being associated with one end of said cutter table;

said second resealer mechanism including a second resealer roll supported by a pair of adjustable sides with said second resealer material end wound thereon, each of said pair of adjustable sides being attached to said first and second beam ends respectively and being moveable with said cutter head beam, each of said adjustable sides being adjusted to position said second resealer roll at a predetermined optimum height with respect to said cutter table support surface and to position said second resealer roll at a predetermined optimum proximity to said cutter tool.

8. The resealer apparatus according to claim 7 wherein each said adjustable side comprises:

a bracket attaching said adjustable side to said beam end;

a slide slidably attaching onto said bracket for adjusting proximity of one end of said slide to said cutter tool; and an adjustable arm with one end thereof pivotably attaching onto said slide and with another end thereof supporting said second resealer roll, said arm pivotable about a pivot to position said second resealer roll at a predetermined optimum height with respect to said cutter table support surface.

9. The resealer apparatus according to claim 8 wherein each said adjustable side further comprises:

means for attaching said slide to said bracket, said means being adjustable to allow relative movement between said slide and said bracket.

10. The resealer apparatus according to claim 9 wherein said means for attaching is a friction lock knob fixedly attaching to said bracket and passing through a first slot formed within said slide, said friction lock knob being loosened to allow sliding movement of said slide relative to said bracket and being tightened to secure said slide relative to said bracket in a predetermined position.

11. The resealer apparatus according to claim 9 wherein each said adjustable side further comprises:

means for guiding said slide relative to said bracket, said means for guiding being spaced apart from said means for attaching.

12. The resealer apparatus according to claim 8 wherein each said adjustable side further comprises:

a locking pin for locking said arm in a predetermined position relative to said slide;

said slide including a plurality of slide pin openings being spaced at a predetermined radius from said pivot and being spaced apart at a predetermined distance from each other with each said slide pin opening being adapted to receive said locking pin;

said arm including an arm pin opening being spaced at said predetermined radius from said pivot to be in register with one of said plurality of slide pin openings, said arm pin opening being adapted to receive said locking pin when said arm is positioned such that said arm pin opening is in register with one of said plurality of slide pin openings.

13. A method for resealing cuts made in a lay of limp sheet material in a cutter system, said method comprising:

placing a lay of limp material onto a cutter table to be cut with a cutter tool supported by a cutter head moveable in one coordinate direction along a cutter head beam, said cutter head beam being moveable in a second coordinate direction from one end of said cutter table to another end thereof;

placing an air impermeable overlay material over a top layer of said lay to conserve vacuum generated by a vacuum source drawing said lay toward a cutter table support surface;

establishing position of said top layer of said lay;

adjusting a height position of an adjustable resealer roll adjustably attached to said cutter head beam to position said adjustable resealer roll directly above said top layer of said lay;

adjusting a proximity position of said adjustable resealer roll to position said adjustable resealer roll in proximity to said cutter tool;

making a plurality of cuts in said lay and said overlay material in accordance with a cutting program with said cutter beam moving in said second coordinate direction along said cutter table and with said cutter head moving in said first coordinate direction along said cutter head beam such that said adjustable resealer roll is traveling with said cutter head beam and a resealer material extending between said adjustable resealer roll and a fixed resealer roll; and resealing said plurality of cuts formed within said lay with said resealer material extending between said fixed and said adjustable rolls being pulled by said vacuum permeating through said plurality of cuts.

* * * * *